United States Patent [19]

Finnicum et al.

[11] 4,147,551

[45] Apr. 3, 1979

[54] PROCESS FOR PHOTOGRAPHIC EMULSION PRECIPITATION IN A RECYCLE STREAM

[75] Inventors: Loren T. Finnicum, Newark, Del.; Stanley H. Munger, Rumson; Donald P. Novak, Eatontown, both of N.J.

[73] Assignee: E. I. Du Pont de Nemours and Company, Wilmington, Del.

[21] Appl. No.: 554,226

[22] Filed: Feb. 28, 1975

Related U.S. Application Data

[63] Continuation-in-part of Ser. No. 280,201, Aug. 14, 1972, abandoned.

[51] Int. Cl.[2] ..... G03C 1/02

[52] U.S. Cl. ..... 96/94 R; 96/94 BF; 96/114.7

[58] Field of Search ..... 96/94 R, 94 BF, 114.7

[56] References Cited

U.S. PATENT DOCUMENTS

| | | | |
|---|---|---|---|
| 3,628,959 | 12/1971 | Theielemann et al. | 96/114.7 |
| 3,705,034 | 12/1972 | McNamara | 96/94 R |
| 3,782,954 | 1/1974 | Porter et al. | 96/94 R |
| 3,790,386 | 3/1974 | Posse et al. | 96/94 R |

FOREIGN PATENT DOCUMENTS

| | | | |
|---|---|---|---|
| 1243356 | 8/1971 | United Kingdom | 96/94 R |

*Primary Examiner*—Jack P. Brammer

[57] ABSTRACT

A process for preparing a photographic emulsion having a controlled grain size, structure and size distribution, wherein precipitation of first silver halide grains is accomplished in a stream, and partial substitution in the first silver halide grains of a second soluble halide is accomplished in a vessel by halide conversion to form mixed crystal silver halide grains. The initially formed mixed crystal silver halide grains are recycled in the stream wherein additional precipitation of the first silver halide occurs on the surfaces of the mixed crystals, which are enlarged. The enlarged crystals are fed from the recycle stream to a vessel wherein additional substitution by halide conversion is accomplished. Continuous or intermittent recycling of the mixed crystal silver halide grains, control of recycle flow rates, control of addition flow rates of silver salts and soluble halides to the process and control of excess halide concentration in the conversion vessel and recycle stream yields mixed crystal silver halide grains having a controlled grain size, structure and distribution.

10 Claims, 1 Drawing Figure

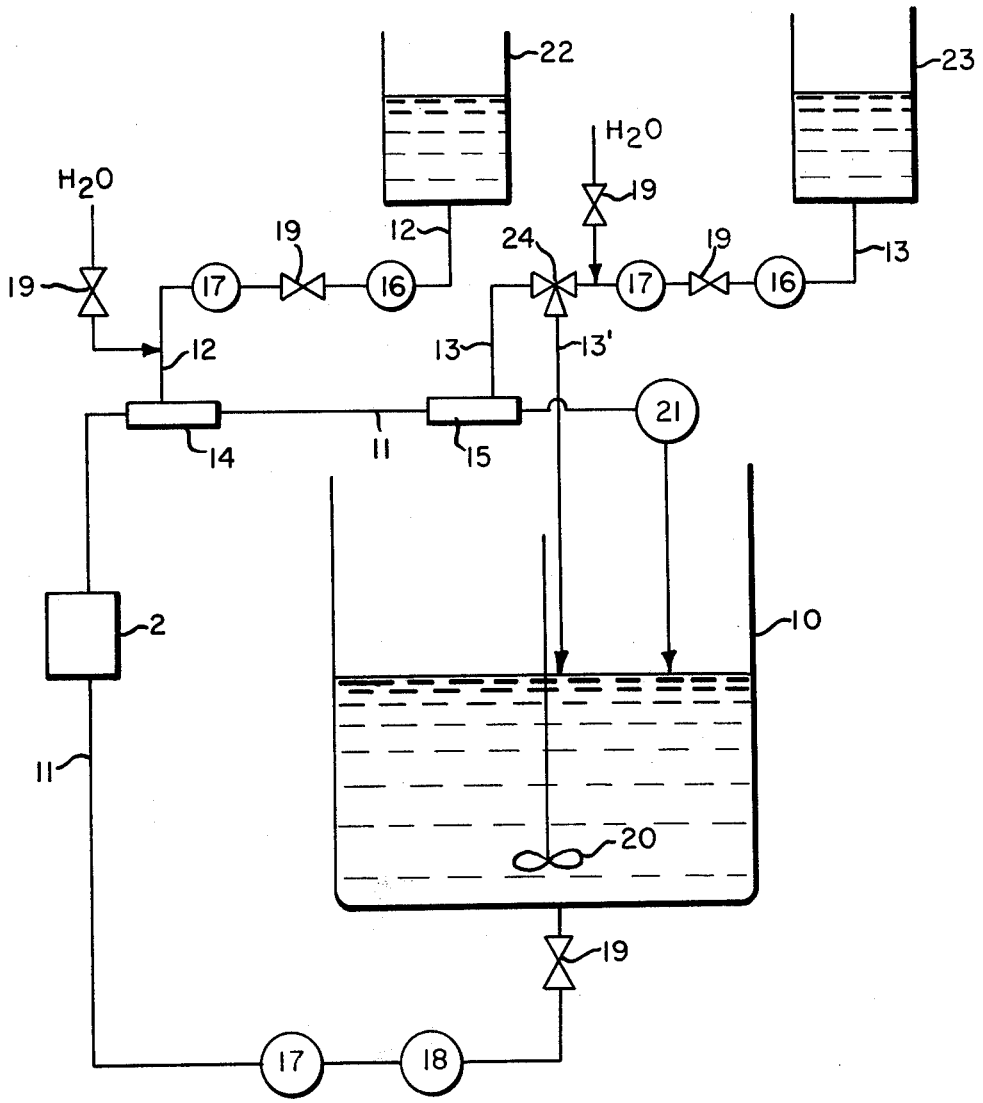
22
23
$H_2O$
19
$H_2O$
19
12
24
19
13
19
17
16
17
16
12
13
13'
21
14
11
15
2
10
11
20
19
17
18

PROCESS FOR PHOTOGRAPHIC EMULSION PRECIPITATION IN A RECYCLE STREAM

CROSS REFERENCE TO RELATED APPLICATIONS

This application is a continuation-in-part of and claims benefit of the filing date of U.S. application Ser. No. 280,201, filed Aug. 14, 1972, now abandoned.

BACKGROUND OF THE INVENTION

1. Field of the Invention

This invention relates to processes for the preparation of photographic emulsions and more particularly to said processes wherein the photographic emulsion contains mixed crystal silver halide grains.

2. Description of the Prior Art

Various processes for the precipitation of silver halide grains are known in the art of preparing photographic emulsions, including double jet processes and stream processes which are described in *The Theory of The Photographic Process,* Third Edition, Mees-James, Macmillan Co., New York (1966) at 31 and 40 respectively. In the double-jet process, the silver nitrate solution and halide solution are simultaneously added to a mixing vessel containing a gelatin solution. In the stream process, the silver nitrate solution and halide solution are fed into a constant volume chamber wherein precipitation of all grains takes place in the same environment.

U.S. Pat. No. 3,415,650, issued to Frame, discloses a process wherein the silver nitrate and halide solutions are fed into a centrifugal mixing chamber submerged in a ripening vessel containing gelatin. The gelatin is drawn into the mixing chamber wherein precipitation of silver halide is accomplished within the confines of the mixing chamber and the silver grains are dispersed in the gelatin. The dispersion is forced through slots in the mixing chamber by centrifugal force into the ripening vessel.

British Pat. No. 1,243,356 discloses a similar process wherein the precipitation chamber is located outside the ripening chamber and at least some of the dispersion in the ripening chamber is recycled to the precipitation chamber.

The objectives of the various processes of the prior art generally include the preparation of reliable and reproducible emulsions at practical rates of throughput. The preparation of such emulsions, and the resulting quality of photographic film made therefrom, is highly dependent on the uniformity of the silver halide grains of the emulsions. Indeed, even with careful ingredient selection, maintaining a photographic environment, and the most skillful subsequent tailoring of the emulsions, significant film quality variations can result from irreproducibilities in the precipitation and ripening steps of the emulsion preparation. Accordingly, it is the object of the present invention to provide a process for preparing a photographic emulsion having silver halide grains of controlled grain size, structure and size distribution.

SUMMARY OF THE INVENTION

The invention comprises a process for preparing a photographic emulsion, having a controlled silver halide grain size, structure and size distribution, comprising the steps, (1) adding silver nitrate to a stream, supplied from a conversion vessel, containing gelatin solution and a first soluble halide salt to initially precipitate first silver halide grains in said stream and form a dispersion, (2) recycling said stream, containing a dispersion of silver halide grains, to said vessel, (3) adding one or more aqueous solutions of said first soluble halide salt and a second soluble halide salt to substitute said first silver halide grains with a second less soluble silver halide by halide conversion in said vessel, thereby forming mixed crystal silver halide grains, and (4) recycling the contents of said vessel into said stream wherein additional silver halide grains are precipitated by said first soluble halide salt and grown on the surfaces of said mixed crystal silver halide grains, to form mixed crystal silver halide grains of controlled structure, size and size distribution.

The process of the invention provides advantages over either the conventional double-jet or stream processes of the prior art in that silver halide grains are precipitated separately in a controlled environment from the environment of the conversion vessel. The conversion vessel initially contains a single first soluble halide salt, but after the initial precipitation and addition of the second halide, it provides the environment for halide conversion. The environment of the conversion vessel can be controlled to facilitate halide conversion, and to substantially exclude the presence of the second soluble halide during precipitation in the recycle stream. Avoiding direct precipitation of silver nitrate with the second halide provides more uniform control of grain structure, size and size distribution. Additionally, flexibility is inherent in the process by providing control of the addition flow rates of silver and halide solutions and the recycle flow rate of the dispersion.

Addition of the one or more aqueous solutions of halide salts may be by injection into the recycle stream, after the initial precipitation, either upstream or downstream of the addition of silver nitrate to the stream, or it may be by direct addition to the conversion vessel.

Addition of silver nitrate and halide salt solutions and recycling of the dispersion may all be either continuous or individually intermittent.

BRIEF DESCRIPTION OF THE DRAWINGS

The drawing is a diagram of an apparatus for carrying out the process of the invention.

DESCRIPTION OF THE PREFERRED EMBODIMENTS

With reference to the FIGURE, an apparatus for practicing the invention comprises a vessel 10 having a jacket for circulating heating and cooling water for receiving the initial charge of gelatin solution and a first soluble halide. An agitator 20 is provided in said vessel. At least two additional vessels 22 and 23 are provided for storing and supplying aqueous silver salt solution and aqueous soluble halide solution, respectively, to the process. A recycle stream 11 is provided to recycle the dispersion formed in the stream 11 to the vessel 10. Mixers 14 and 15 are provided in the recycle stream for adding silver salt solution to the process from vessel 22 through stream or conduit 12 and for adding aqueous halide solution from vessel 23 through stream or conduit 13. Conduit or stream 13' is provided for direct addition of aqueous halide solution to vessel 10. Rotameters 17 are provided in the recycle stream 11 and in streams 12 and 13 for measuring flow rates in the process. Control valves 19 are provided in all three streams.

Recycling pump 18 is provided in line 11 for recycling and controlling the contents of vessel 10. Metering pumps 16 are provided for controlling the flow rates of silver salt solution and aqueous halide solution added to the process. A three-way valve 24 is provided in stream 13 for selecting addition of aqueous halide solution to stream 11 or directly to the vessel 10. Similarly three-way valves (not shown) may be provided in stream 11 from vessel 10 for recycling the contents to the vessel or for feeding the contents to another vessel. Also a three-way valve may be provided in line 12 for direct addition of aqueous silver salts to vessel 10. A pAg meter 21 is provided in stream 11 for monitoring the silver ion concentration in the recycle stream. Additional pAg meters (not shown) may be provided for monitoring the silver ion concentration at other locations in the process. The rotameters and pAg meters may be used to generate control signals for controlling flow rates in the process and controlling pAg or excess halide concentration at various points in the process. A heat exchanger 25 may be provided for controlling temperature in the recycle stream by circulation of hot and cold water.

The mixers 14 and 15 are preferably tee-mixers, although other types of static or dynamic mixers may be used. Using a conventional side tee-mixer the main stream of the mixer is used for the recycle stream of the process and the side stream of the mixer is used as the condition stream for aqueous silver salts and aqueous halide solutions. The side tee-mixer provides highly efficient mixing and precipitation in a reasonably short length of the recycle stream e.g. substantially 100% mixing and precipitation of silver halide is accomplished within 3 to 7 stream diameters of the silver solution tee addition when the mass velocity ratio of the side stream to the main stream is 2.7. The optimum mass velocity ratio of 2.7 must be maintained for efficient mixing and precipitation of the components in a tee-mixer. However, mixing times may be controlled by varying the recycle flow rate and proportionally changing the side stream flow rate.

The recycle ratio for the process is defined as the ratio of the recycle flow rate to the silver solution flow rate. Although any recycle ratio may be used, it is preferred to maintain the recycle ratio greater than or equal to 10.

In order to reduce Ostwald ripening and coalescence and accomplish substitution by halide conversion, an upper limit of 1.50 moles per liter excess halide is maintained in the conversion vessel, however a limit of substantially less than this is preferred, e.g. 0.03 moles per liter excess halide. The start of addition of the aqueous halide solution is preferably delayed or lags the start of the addition of silver solution by a prescribed lag time, e.g. 0–5 minutes.

The process of the invention is useful for preparing mixed crystal silver halide emulsion for photographic films having controlled grain structure, size and size distribution over a wide latitude, for example cubic, mixed cubic and octahedral or octahedral grains, having median particle sizes in the range 0.2 microns to 2.0 microns and geometric standard deviations in the range 1.1–1.6 with skew ±0.01–±0.40. Temperature and pAg may be varied over a wide range in the recycle stream and conversion vessel to achieve the desired grain structure, size and size distribution, for example, temperature at precipitation in the stream, and at conversion in the vessel may be separately controlled within the range 100° F.–160° F., and pAg may be controlled within the range 6–11 at precipitation to achieve the grain structure desired.

The process of the invention has been found particularly useful for producing fine grain, cubic structure, chlorobromide emulsions useful for lithographic films as exemplified below.

EXAMPLE I

A gel-halide solution (A) was prepared and digested in the conventional manner, comprising:

24,000 ml. distilled water
600 g. gelatin
42 g. Sodium Chloride and was placed in the conversion vessel heated to 150° F. and agitated.

A 12,000 ml. aqueous solution of 1.5 molar silver nitrate (B) was prepared in a conventional manner, placed in the silver solution storage and supply vessel and heated to a temperature of 136° F.

An aqueous solution of soluble halide (C) was prepared in a conventional manner, comprising:

11,580 ml. distilled water
780 g. Sodium Chloride
556 g. Sodium Bromide and was placed in the halide solution storage and supply vessel and heated to a temperature of 138° F.

The digested gel-halide solution (A) was fed into the recycle stream at a flow rate of 9 gallons per minute (gpm). Silver nitrate solution (B) was added to the recycle stream at a flow rate of 0.11 gpm through a 0.083 inch diameter side stream of a tee-mixer having a 0.67 inch main stream. The aqueous solution of soluble halides (C) was added directly to the conversion vessel at a flow rate of 0.11 gpm. The dispersion of initially precipitated silver chloride grains was recycled to the vessel. The dispersion in the vessel was continuously recycled at a recycle ratio of 82. Silver nitrate solution was continuously added at the 0.11 gpm flow rate to the recycle stream. Aqueous soluble halide solution was continuously added directly to the vessel at the 0.11 gpm flow rate. The addition of aqueous silver and halide solutions was completed in 30 minutes. The dispersion of mixed crystal silver halide grains was immediately quenched by addition of 22,000 ml of distilled water at approximately 72° F. and by circulating chill water at 55° F. in the jacket of the vessel till the temperature of the contents of the vessel was lowered to 84° F. The contents of the vessel were coagulated and washed in a conventional manner to produce emulsion curds.

Subsequently the curds were redispersed, sensitized and coated on a photographic support, as is well known in the art of manufacturing photographic films, to produce a lithographic film having high sensitivity and good dot quality. The grain structure determined by electron micrograph of the mixed crystal silver halide grains was cubic. The grain size distribution determined by mass settling had a median particle size of 0.32$\mu$, with a geometric standard deviation of 1.24 and skew of −0.05.

EXAMPLE II

Gel-halide, aqueous silver nitrate and aqueous soluble mixed halide solutions were prepared and placed in the conversion and storage vessels as in Example I.

Aqueous silver nitrate was added to the recycle stream at a flow rate of 0.106 gpm as in Example I. The aqueous solution of mixed halides was added to the recycle stream through a 0.67 inch diameter side stream of a tee-mixer upstream from the silver addition at a flow rate of 0.106 gpm.

The recycle ratio of the dispersion in the conversion vessel was 78, and the contents of the vessel were continuously recycled for 30 minutes, while the aqueous silver and aqueous halide solutions were continuously added.

The contents of the vessel were quenched, coagulated and washed, and subsequently redispersed and coated as in Example I to produce a lithographic film having high sensitivity and good dot quality. The structure of the mixed crystal silver halide grains was substantially cubic, although some twin crystals were present. The grain size distribution had a median particle size of 0.33μ with a geometric standard deviation of 1.34 and skew of −0.03.

EXAMPLE III

A gel-halide solution was prepared in the manner of Example I, comprising 306,000 ml distilled water
900 g. Sodium Chloride
7,500 g. gelatin placed in the conversion vessel and heated to 150° F.

A 150,000 ml aqueous solution of 1.5 molar silver nitrate was prepared in the manner of Example I placed in a silver storage vessel and maintained at a temperature of 130° F.

An aqueous solution of soluble mixed halides was prepared as in Example I, comprising 152,000 ml distilled water
9,650 g. Sodium Chloride
6,960 g. Sodium Bromide placed in a halide solution storage vessel and maintained at a temperature of 130° F.

Gel-halide solution was fed from the conversion vessel to the recycle stream at a flow rate of 93 gpm. Silver nitrate solution was continuously added to the recycle stream at a flow rate of 1.36 gpm through a 0.151 inch diameter side stream of a tee-mixer having a 1.875 inch diameter main stream. The aqueous solution of soluble halides was continuously added after a 30 second delay following the start of the addition of silver solution directly to the conversion vessel as in Example I at a flow rate of 1.40 gpm. The contents of the conversion vessel were continuously recycled at a recycle ratio of 68 for 32 minutes. pAg in the recycle stream was maintained at approximately 6.4.

The dispersion of mixed crystal silver halide grains was quenched by the addition of 416,000 ml of water at approximately 60° F. and by circulating chill water in the jacket of the conversion vessel till the temperature of the contents of the vessel was lowered to 84° F.

The contents of the conversion vessel were coagulated and washed, as in Example I, and subsequently redispersed and coated on a photographic support to produce a high sensitivity lithographic film having good dot quality.

The structure of the mixed crystal silver halide grains was cubic. The grain size distribution had a mean particle size of 0.36μ, with a geometric standard deviation of 1.18 and skew −0.09.

EXAMPLE IV

Gel-halide, aqueous silver nitrate and aqueous soluble halide solutions were prepared, and placed in the conversion vessel and storage vessels as in Example III.

The gel-halide solution was fed into the recycle stream at a flow rate of 101 gpm. Silver nitrate solution was continuously added to the stream through a 0.136 inch diameter side stream of a tee-mixer having a 1.875 inch diameter main stream at a flow rate of 1 gpm. After a 1 second delay following the start of addition of silver solution, aqueous halide solution was continuously added to the recycle stream, 51.5 inches downstream of the silver solution addition tee-mixer, through the side stream of an identical tee-mixer at a flow rate of 1.22 gpm. The contents of the conversion vessel were continuously recycled for 40 minutes until the addition of silver and mixed halide solutions was complete. The recycle ratio was 101. pAg in the recycle stream was maintained at 7.1–7.3 and was 7.15 in the conversion vessel when recycling was stopped.

The contents of the conversion vessel were coagulated and washed and subsequently redispersed and coated on a photographic support to produce a high sensitivity lithographic film having good dot quality.

The structure of the mixed crystal silver grains was generally cubic, with some twins. The grain size distribution had a mean particle size of 0.34μ with a geometric standard deviation of 1.37 and skew −0.04.

EXAMPLE 5

Two gel-halide solutions (A) were prepared and digested in a conventional manner, comprising:

14,280 grams distilled water
350 grams gelatin
42 grams sodium chloride

Two aqueous solutions of 3 molar silver nitrate (B) were prepared in a conventional manner, comprising:

3,940 grams distilled water
5,220 grams silver nitrate and two aqueous solutions of soluble halides (C) were prepared in a conventional manner, comprising:

7,580 grams distilled water
480 grams sodium chloride
350 grams sodium bromide

Solution (A) was placed in a conversion vessel, heated to 150° F. and agitated. Solution (B) was placed in a silver solution storage and supply vessel and heated to a temperature of 127° F. Solution (C) was placed in a halide solution supply and storage vessel and heated to a temperature of 130° F.

In Method 1 the digested gel halide solution (A) was fed into the recycle stream at a flow rate of 0.7 gallons per minute (gpm). Silver nitrate solution (B) was continuously added to the recycle stream at a flow rate of 0.07 gpm through a 0.187 inch side stream of a tee-mixer having a 0.857 inch diameter main stream. The aqueous solution of soluble halides (C) was continuously added directly to the conversion vessel as in Example 1, at a flow rate of 0.07 gpm. The contents of the conversion vessel were continuously recycled at a recycle ratio of 10 for 29 minutes. pAg in the conversion vessel was maintained at approximately 6.6–6.0.

The dispersion of mixed crystal silver halide grains was pumped to a separate vessel and quenched with water to lower the temperature of the mixture to 85° F.

The contents were then coagulated and washed, as in Example 1 and subsequently redispersed, sensitized and coated on a photographic support to produce a silver halide film having high sensitivity. The grain structure determined by electron micrographs of the mixed crystal silver halide grains was cubic. The particle size distribution was determined using a particle size analyzer and the results are tabulated in Table 1. Sensitometric results are listed in Table 2.

In Method 2, which serves as a control, Solution A is fed from the conversion vessel to the recycle stream at a flow rate of 0.7 gpm, similar to that used in Example 1. Solutions B and C were added together and continuously to the recycle stream through a 3000 revolutions per minute (rpm) centrifugal pump mixer in which the solutions were thoroughly mixed. The silver solution and halide solution were added at flow rates similar to those used in Method 1. The contents of the conversion vessel were continuously recycled at a recycle ratio of 10 for 29 minutes. pAg of the vessel contents was maintained at 7.1–6.5.

The dispersion of mixed crystal silver halide grains was quenched, coagulated, washed and subsequently redispersed, sensitized and coated on a photographic support as described in Method 1.

The grain structure determined by electron micrographs of the mixed crystal silver halide grains was a mixture of cubes and twins. The particle size distribution determined with a particle size analyzer was broad compared to the narrower size distribution of the grains produced by Method 1. The results are shown in Table 1.

Table 1

| | Particle Size Analyzer | | | |
|---|---|---|---|---|
| | Median | Distribution Width | | |
| Emulsion | Volume Cu. Microns | Alpha | Geom. Std. Dev. | Skew |
| Method 1 | 0.014 | 0.79 | 1.27 | −0.079 |

| | Electron Microscope | |
|---|---|---|
| | Shape of Grains | Edge Length Range Microns |
| | 99.9% cubic<br>0.1% Twins | 0.2 to 0.4 |

| | Particle Size Analyzer | | | |
|---|---|---|---|---|
| | Median | Distribution Width | | |
| Emulsion | Volume Cu. Microns | Alpha | Geom. Std. Dev. | Skew |
| Method 2 Control) | 0.012 | 1.69 | 1.69 | −0.005 |

| | Electron Microscope | |
|---|---|---|
| | Shape of Grains | Edge Length Range Microns |
| | 50% cubic<br>50% Twins | 0.2 to 0.5<br>Cubes<br>Pyramid Twins<br>0.96 to 0.64 |

Results of the sensitometric tests are listed below in Table 2.

Table 2

| Emulsion | Speed | Gradient | Top Density |
|---|---|---|---|
| Method 1 | 255.60 | 3.10 | 3.80 |
| Method 2 (Control) | 243.00 | 2.60 | 3.30 |

Films made with the emulsion prepared by Method 1 had a 16% better gradient, 13% better top density and a 5% better speed than films made with the emulsion prepared by Method 2 (control).

EXAMPLE 6

Two silver chlorobromide emulsions were prepared by Method 1 and Method 2 respectively as described in Example 5. The emulsions were coagulated and washed, as in Example 1 and subsequently redispersed, chemically sensitized with conventional sulfur and gold sensitizers and panchromatically sensitized with a mixture of a merocyanine and two carbocyanine type dyes, and coated on photographic supports to produce lithographic films. The grain structure determined by electron micrographs of the mixed crystal silver halide grains prepared by Method 1 was cubic whereas that of the grains prepared by Method 2 (control) was a mixture of cubes and twins. Sensitometric results of the exposed and developed samples are listed in Table 3.

TABLE 3

| | Speed | | |
|---|---|---|---|
| Emulsion | Red | Green | Blue |
| Method 1 | 76 | 55 | 65 |
| Method 2 (Control) | 46 | 30 | 30 |

Although the process of the invention is exemplified with reference to the preparation of a photographic emulsion containing mixed crystal silver chlorobromide having fine grain and cubic structure, such exemplification is merely illustrative and not limiting. The process is equally useful for preparation of photographic emulsions having other mixed cyrstal silver halide grains, e.g. silver iodobromide, silver iodochloride and silver iodochlorobromide, by precipitation and substitution by halide conversion. Similarly other soluble halides are suitable for use in the precipitation and substitution in the process, e.g. ammonium halides and other alkali metal halides which are well known in the preparation of photographic emulsions.

Additionally, the recycling of the contents of the conversion vessel and addition of silver salt and soluble halide solution may be intermittent rather than continuous. Also a plurality of mixers may be used in the recycle stream for addition of the silver salt and soluble mixed halide solutions if desired.

Auxiliary conventional ripening techniques which are well known in the art of manufacturing photographic emulsions may be employed in the conversion vessel if desired in conjunction with intermittent recycling.

Control of flow rates of silver salt and soluble halide solution may be accomplished by using flow valves or variable speed pumps. Changes in flow rates must be maintained within limits to insure the mass velocity ratio of the main stream and side stream within limits of the 2.7±10% required for efficient mixing. Variations in flow rates may also be accomplished by interchanging tee-mixers or using other mixers well known in the mixing arts.

The recycle stream may be divided into a plurality of individual streams to which silver nitrate and halide salt solutions are individually added. Thus, silver nitrate or equivalent silver salt solution may be added to one stream and halide salts may be added to another.

The process of the invention is particularly useful for making monodisperse, cubic structure, silver chlorobromide grains of controlled size, structure and size distribution.

We claim:

1. A process for preparing a photographic emulsion, having a controlled grain size, structure and size distribution, comprising the steps, (1) adding silver nitrate to a stream, supplied from a conversion vessel, containing gelatin solution and a single first soluble halide salt to initially precipitate first silver halide grains in said stream and form a dispersion, (2) recycling said stream, containing a dispersion of silver halide grains, to said vessel, (3) adding one or more aqueous solutions of said first soluble halide salt and a second less soluble halide salt to substitute said first silver halide grains with said second less soluble silver halide by halide conversion in said vessel, thereby forming mixed crystal silver halide grains, and (4) recycling the contents of said vessel into said stream wherein additional silver halide grains are precipitated by said first soluble halide salt and grown on the surfaces of said mixed crystal silver halide grains, to form mixed crystal silver halide grains of controlled structure, size and size distribution.

2. A process according to claim 1 wherein said silver nitrate solution and said one or more aqueous solutions of first soluble halide salt and second soluble halide salt are added continuously to said stream.

3. A process according to claim 1 wherein said silver nitrate solution and said one or more aqueous solutions of first soluble halide salt and second soluble halide salt are added intermittently to said stream.

4. A process according to claim 1 wherein the addition of said one or more aqueous solutions of first soluble halide salt and second soluble halide salt is started after the start of addition of said silver nitrate solution.

5. A process according to claim 1 wherein halide salts are added directly to said conversion vessel.

6. A process according to claim 1 wherein said stream is recycled intermittently.

7. A process according to claim 1 wherein said one or more aqueous solutions of first soluble halide salt and second soluble halide salt are added to said stream downstream from the addition of said silver nitrate solution.

8. A process of claim 1 wherein there is a plurality of additions of said silver nitrate solution and said one or more aqueous solutions of first and second soluble halide salts.

9. A process of claim 1 wherein said stream is divided into a plurality of individual streams to which silver nitrate and halide salt solutions are individually added.

10. A process of claim 1 wherein said mixed crystal silver halide grains are monodisperse, cubic structure, silver chlorobromide grains.

* * * * *